United States Patent [19]

Trautweiler

[11] 4,355,099

[45] Oct. 19, 1982

[54] COMPOSITE PHOTOGRAPHIC MATERIAL HAVING A THIN FLEXABLE SUPPORT AND A REFLECTING LAYER

[75] Inventor: Franz Trautweiler, Fribourg, Switzerland

[73] Assignee: Ciba-Geigy AG, Basel, Switzerland

[21] Appl. No.: 278,792

[22] Filed: Nov. 29, 1981

Related U.S. Application Data

[62] Division of Ser. No. 54,044, Jul. 2, 1979, Pat. No. 4,296,198.

[30] Foreign Application Priority Data

Jul. 7, 1978 [CH] Switzerland ..... 7421/78

[51] Int. Cl.[3] ..... G03C 1/78

[52] U.S. Cl. ..... 430/531; 430/532; 430/533; 430/525; 430/538; 430/534; 430/535; 430/536; 430/537; 430/271

[58] Field of Search ..... 430/206, 531, 532, 533, 430/13, 432, 403, 404, 961, 534, 535, 536, 537, 271, 538, 525

[56] References Cited

U.S. PATENT DOCUMENTS

| | | | |
|---|---|---|---|
| 2,698,239 | 12/1954 | Alles et al. | 430/533 |
| 3,238,043 | 3/1966 | Levy | 96/63 |
| 3,885,080 | 5/1975 | Lambert et al. | 430/533 |

FOREIGN PATENT DOCUMENTS

| | | |
|---|---|---|
| 355303 | 8/1931 | United Kingdom . |
| 1068565 | 5/1967 | United Kingdom . |
| 1182301 | 2/1970 | United Kingdom . |
| 1488343 | 3/1977 | United Kingdom . |

OTHER PUBLICATIONS

Modern Plastic Encyclopedia, vol. 40, No. 1A, Sep. 1962,, pp. 10 and 556–557.

Glafkines Photographic Chemistry, vol. 1, pp. 467–469.

Baker, Photographic Emulsion Technical, Second Ed. pp. 226–231.

Hersh et al, Photographic Science & Engineering, vol. 5, No. 1, Jan. 1961, pp. 48–54.

*Primary Examiner*—Jack P. Brammer

*Attorney, Agent, or Firm*—Harry Falber

[57] ABSTRACT

For the production of positive photographic prints a composite material in strip form is used as an intermediary to form the print images and is then adhered in a continuous procedure to a main support strip such as paper. The resultant strip is then cut to separate the individual prints. The composite material has a transparent film of biaxially-oriented plastics film not more than 50μ thick and water-resistant and to which photosensitive emulsions are applied, and a further layer overlying the emulsions to protect them, the further layer being adhered to the main support. This layer is reflective, as by incorporation of a white pigment, so that the image is seen through the transparent film against the background of this layer rather than the main support. The reflective layer may contain other chemicals relevant to processing.

9 Claims, 6 Drawing Figures

COMPOSITE PHOTOGRAPHIC MATERIAL HAVING A THIN FLEXABLE SUPPORT AND A REFLECTING LAYER

This is a divisional of application Ser. No. 054,044 filed July 2, 1979, now U.S. Pat. No. 4,296,198.

FIELD OF THE INVENTION

This invention is concerned with a process for the production of photographic prints and with a photographic printing material.

The invention has particular, though not exclusive, application to the production of positive photographic prints on a continuous strip of printing material, which process is often associated with large scale automatic film developing and printing systems.

BACKGROUND TO THE INVENTION

Material for the production of photographic prints conventionally comprises a sheet-form main substrate or support, photosensitive material on the support sheet and an overlying layer of protective material. The term "photosensitive material" as used herein includes those materials, which may be formed in a number of layers, which contribute to the formation of the visual image in the final print. The photosensitive material includes photosensitive emulsions, a number of which may be utilised in producing colour prints, and emulsions or other materials required for auxiliary functions in the forming of the image such as support for dyes, protective filters and so on.

The protective layer above-mentioned usually consists of hardened gelatin, possibly with the addition of other colloidal emulsion-formers or plastics, which are intended to improve the mechanical properties of the protective layer. Such protective layers occasionally also contain means for changing the texture and the reflecting power, e.g. matting agents.

Since such protective layers swell in water, they are sensitive to undesirable marks such as water stains, finger-marks, and so on.

The main substrate or support used in most cases for photographic printing materials is paper. Apart from the fact that it is cheap, paper has important advantages: it can readily be manufactured in different weights and with different textures. It can be coloured and have various coatings. However, paper also has disadvantages which have an adverse effect on its use as a support for photographic images.

With wet processes of the kind conventional in photography the paper loses its mechanical strength and dimensional stability for example. Because of its absorption it can absorb large quantities of chemical processing solutions so that there is a risk of chemicals being transferred from one bath to another during processing. Finally, paper prints usually have to be washed for a very long period to make them durable and as free from harmful chemicals as possible.

There are known steps adapted to obviate these disadvantages. For example, the paper used as an emulsion support for positive photographs can be replaced, for example, by an opaque non-absorbent plastics film, e.g. a white-pigmented triacetate or polyester film. Such materials are expensive and unsuitable for mass sales, however, in the thickness required for photographic prints. Another method of producing non-absorbent image supports is to coat paper with a thin plastics film.

Thus at the present time papers coated with polyethylene on both sides are being used in large quantities for the production of photographic prints. Support materials of this kind are relatively cheap, but they still have some disadvantages. For example, the edges of cut papers are of course unprotected. Chemicals can penetrate into the paper felt here and cause edge discoloration. In practice, the polyethylene surface is wetted unevenly; it is very difficult to produce uniform layers on such a surface without some cloudiness.

United Kingdom Patent Specification No. 355,303 (Saunders) issued in 1931 describes a process for the production of black and white positive photographs in which a black and white transparency is first produced in an emulsion carried on a conventional celluloid support and is cemented at the emulsion side to a reflecting support paper after processing and drying. This process avoids some of the above disadvantages of conventional paper prints; more particularly, the paper does not come into contact with chemical processing solutions and the outwardly facing celluloid film effectively protects the image from mechanical damage.

There is no appreciation in the Saunders specification that his process can have the advantage of avoiding contact between the paper and processing chemicals, nor has the Saunders process become established. One reason for this is the use of celluloid, which is conventional in the photographic industry, as a support for the photographic emulsions. Such supports are at least 60$\mu$ thick and relatively stiff. Because of their stiffness they are not easy to cement. Celluloid supports are also relatively expensive.

Another disadvantage of the process disclosed by the Saunders specification is that if laterally correct photographs are to be obtained exposure must either be through the celluloid support or laterally reversed directly on to the emulsion side. Exposure through the support results in lack of sharpness which increases with the support thickness. Laterally reversed exposures are unpopular in printing for various reasons. Cementing the image-bearing emulsion layer to the paper support can result in a further loss of sharpness.

Printers have to keep in stock printing materials not only of different gradation but also of different surface types (textures) and thicknesses. This occupies a considerable amount of space and requires capital. The potential for easing this problem offered by the process disclosed in the Saunders specification has not been previously recognised.

One object of the present invention is to enable positive photographic prints to be produced without contacting the main paper support with processing chemicals while obviating the difficulties arising out of the process of Specification No. 355,303.

SUMMARY OF THE INVENTION

The invention is concerned with a process for the production of a photographic print including the steps of providing a composite photographic material comprising a transparent support layer carrying photosensitive material, such as photosensitive emulsions and auxiliary materials associated with image reproduction, forming the print image including at least the steps of exposing the photosensitive material and developing the exposed material, and then adhering the image-bearing composite material to a main support of greater thickness than the aforementioned support layer.

In one form the invention provides the support layer as a flexuous layer of not more than 50μ (fifty micrometers) thickness. The support layer may be realised by a transparent film exhibiting flexibility or suppleness. In the finished print the image-bearing photosensitive material lies protected between the main support and the support layer or auxiliary support as it may be called.

In another form the invention provides the composite material to have a further layer between which and the transparent support layer the photosensitive material is disposed. The further layer is adhered to the main support and serves to isolate and protect the visual image from the adhesive. The further layer may incorporate chemicals relating to the processing of the composite material or the inactivation of processing chemicals or their reaction products. In a preferred embodiment the further layer is reflective, as by incorporation of a pigment of high reflecting power. This layer then serves as the base against which the image is seen or prepared leaving the choice of main support substantially independent of its light-reflecting properties. In its preferred form the process of the invention includes both providing the transparent support layer as a flexuous layer of not more than 50μ thickness and providing the composite photographic material with an additional light-reflective layer between which and the transparent layer the photosensitive material is disposed. The additional layer is then adhered to the main support. The main support can be paper or any other desired material.

With the process according to the invention, the choice of main support is free right up until the finished photograph is produced. Finished photographs on, for example, paper of different weights and textures can therefore basically be produced from one composite material.

Plastics films are very suitable as a material for the very thin auxiliary support layer. Films of this kind are produced in large quantities for the packaging industry and are very cheap. Because they are so thin the space required for storing and processing is small. Reels of a greater total length for a given area of film material can be used both in the coating machines and in the printing and processing machines, because of the thinness and low weight per unit area. Loss of time involved in reel changing and loss of material at the beginning and end of the individual rolls are reduced as a result.

The provision of a reflective layer directly on the photosensitive material can serve to make the material completely independent of the reflecting properties of the main support, so that the range of main supports that needs to be stocked can be reduced. The properties of the reflective layer can be controlled and the subsequent adhesion to the main support has little or no influence on the reflecting properties.

The invention also relates to a composite photographic material usable as an intermediate material for the production of positive prints. According to the invention a support layer for the photosensitive material is a transparent and water-resistant film of a maximum thickness of 50μ. More particularly the film thickness is in the range of 5 to 50μ and preferably in the range of 15 to 30μ.

According to one particularly advantageous variant, the composite material has an additional reflective layer between which and the transparent support layer the photosensitive material is disposed. Preferably the reflective layer contains a white pigment of high reflecting power.

The invention and its practice will now be further described with reference to an illustrated embodiment.

DESCRIPTION OF THE PREFERRED EMBODIMENT

Figure 1:
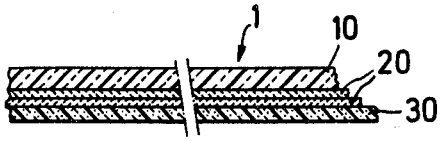
FIG. 1 is a cross-section through a strip of a composite printing material in accordance with the invention for use as an intermediate material in producing positive photographic prints in the process illustrated in FIGS. 2 to 6.

FIG. 1 is a section of a composite photographic material 1 in strip form. It consists of a transparent auxiliary support 10 comprised of a film of a maximum thickness of 50μ, a number of photographic emulsions 20, which together with any other auxiliary layers for image production constitute the photosensitive material layer, and a gelatin protective base 30, which, if required, may be white-pigmented. The protective function of the layer 30 is utilised only before and during processing. The film 10 acts as a surface protection for the final image (as will be seen from FIG. 5 onwards).

Figure 2:
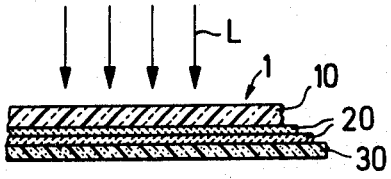
FIG. 2 illustrates the exposure of a portion of the composite material.

FIG. 2 is a diagram showing the exposure of a portion of the composite strip as denoted by the rays of light L. The exposure forms one latent image. A succession of image exposures is made along the strip.

Figure 3:
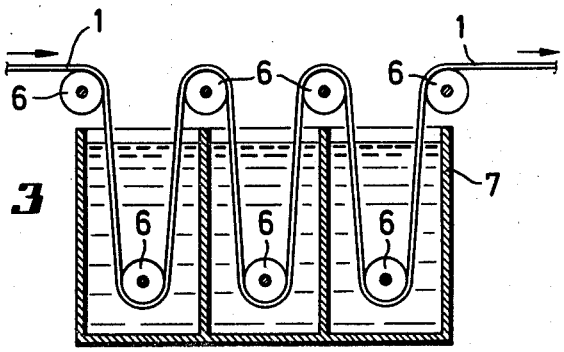
FIG. 3 illustrates the developing and general processing of a strip of the exposed composite material.

FIG. 3 shows in a highly diagrammatic manner the development of the exposed strip and any other processing required. The strip printing material 1 is conveyed through the treatment baths of a multi-chamber tank 7 via guide rollers 6. Processing techniques are well known and will not be described further here since they are not material to an understanding of the present invention.

Figure 4:
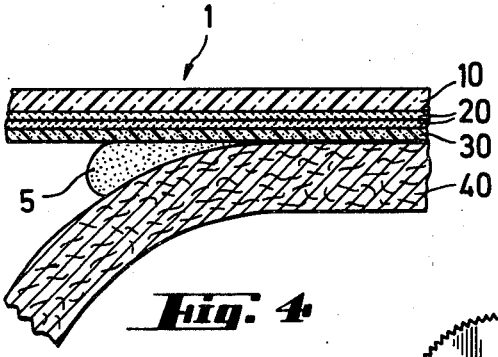
FIG. 4 illustrates the subsequent step of adhering the composite material to a main support or substrate.

After development, fixing and washing, the material which until then had been borne substantially only by the flexible and transparent auxiliary support 10 is stuck on to a main support, the layer 30 being actually adhered to the latter. This operation is shown in FIG. 4, the main support (usually a paper support) being denoted by reference 40 and the adhesive by reference 5. This is done in a continuous operation.

Figure 5:
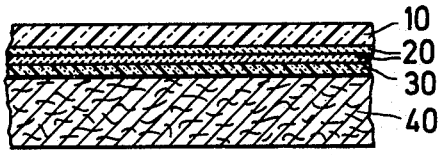
FIG. 5 is a cross-section through the resultant print strip.

FIG. 5 shows the arrangement of the layers in the finished strip of photographic material. The layer 30 is next adjacent the main substrate 40. The photosensitive material now exhibiting the developed image lies between the layer 30 and transparent film 10. The film thus provides the top surface of the succession of prints. The nature of the film is further discussed hereinafter.

Figure 6:
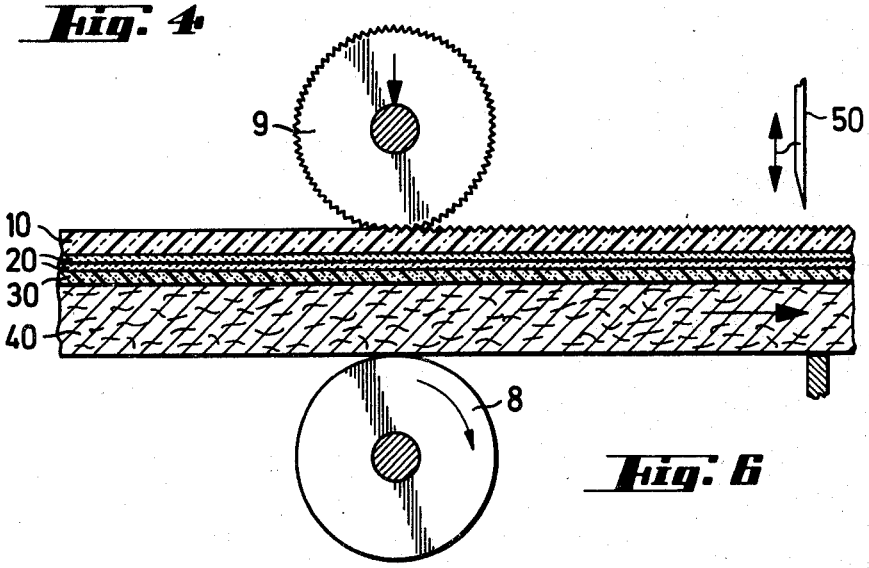
FIG. 6 shows a final step in texturing the print strip and separating the strip into individual prints.

FIG. 6 shows further steps in the processing of the finished strip of FIG. 5, including the application of surface texture by calendering and the cutting of the paper into the individual prints. Calendering is effected by means of the two rollers 8 and 9, the roller 9 being provided with a surface relief which is impressed by pressure and heat into the top surface of the film 10. The roller diameters are very much greater than the material thickness. A reciprocating cutter 50 is used for cutting the strip into the individual prints.

Calendering may be carried out simultaneously with the adhering operation (FIGS. 4 and 5).

The transparent plastic film 10 is water-resistant and of a thickness in the range of from 5 to 50μ, more particularly 15 to 30μ. It is chosen to have sufficient strength, chemical resistance to photographic processing solutions, and some degree of dimensional stability. Thermal stability is also desirable so that the support can withstand processing temperatures of up to 60° C. To enable the photographic emulsions to be applied uniformly without difficulty, the plastics film must also have adequate wettability. In some cases it may be necessary to provide the emulsion side of the film with a wettable layer for receiving the emulsions.

Suitable thin plastics films are, for example, polyethylene or polypropylene, the latter being available inter alia under the trade names Forco OPP (Forchheim), Propafilm (ICI), Moplefan (Montedison), Trespaphan (Kalle) or Ultralen (Lonza): the manufacturers are indicated in parentheses.

Other suitable sheets are those of polyethylene terephthalate (Hostaphan, Kalle), polycarbonate (Pokalon, Lonza), regenerated cellulose (cellophane), polyamide, Polyimide, polystyrene, cellulose nitrate (celluloid), cellulose acetate (Ultraphan, Lonza), acrylonitrile copolymers (Barex, Lonza), polysulphone, polyvinyl chloride, and polyvinylidene chloride. Biaxially oriented (stretched) films are preferably used. The film used preferably contains plasticizers to enhance its flexibility.

Paper is, of course, primarily suitable as the main support 40 for the photographic images but other materials can be used, e.g. textiles, opaque plastics sheets or packaging materials, preferably all having a thickness in the range of SO to 300μ. Metals, glass, wood, and so on can also be used as the main support. Another feasible use would be on plaster or brickwork, e.g. as a wall covering.

The reflecting power of the finished image is advantageously adapted to specific requirements by the incorporation of a white pigment or some other reflecting material. A suitable reflecting layer contains about 1 to 20 g titanium dioxide per square meter, for example, finely distributed in a binder such as gelatin. In addition to titanium dioxide, other white pigments are possible such as zinc oxide, zinc sulphide, lithopone, zirconium oxide, barium sulphate, lead sulphate, lead carbonate, and so on. The reflecting agent may, for example, be applied as the top layer to the subsequent main support 40, or may be distributed in the adhesive 5. Advantageously, however, the reflecting pigment is incorporated in the layer 30 applied to the composite material above the photographic emulsions 20. A top layer of this kind additionally has a protective function and is intended to protect the photographic emulsions therebeneath from mechanical damage until the composite material has been adhered (cemented to the main support.

Other possibilities for exploitation of the covering and protective layer 30 are, for example, obtained by the incorporation of chemicals. For example, a developer or a pre-developer may be incorporated in the layer so that only the action of an alkaline activator solution is required for development. Substances capable of fixing surplus processing chemicals or their reaction products may also be incorporated, and this may have the effect of simplifying or accelerating processing as necessary. Finally, the layer may have a very high swelling power in order thus to increase its absorbency for chemicals. This is readily achieved by hardening the layer only slightly, if at all, thus increasing its absorbency to water.

All kinds of glue may be used as adhesive 5 for joining the processed photographic material to the paper support 40 provided they stick sufficiently both to the layer 30 of the intermediate composite material and to the paper 40, and ensure a permanent adhesive connection. Vegetable and animal glues are suitable, such as starch, starch derivatives, casein, fish glue, gelatin and derivatives thereof, cellulose derivatives, and so on. Water-soluble adhesives are preferable if the processed material is to be glued in the wet state. Dispersion adhesives are also suitable adhesives, i.e. aqueous dispersions of water-insoluble tacky plastics. Fusible adhesives can also be used, i.e. adhesives which are applied as a dried layer to the paper or the top layer of the image support and can be made tacky simply by heating.

The photographic emulsions 20 and the protective or reflecting layer 30 are of the usual printing material thickness, i.e. about 1 to 5μ per layer.

Two specific examples for the production of photographs by the process of the invention will now be described:

EXAMPLE 1

A biaxially stretched polyethylene terephthalate film of a thickness of 20μ was made wettable conventionally by substrating and provided with the following photographic cmulsions:

(a) A photosensitive silver halide emulsion consisting of silcer bromide of an average particle size of 0.5μ dispersed in an aqueous gelatin solution with the addition of butyl natphthalene sulphonate (Nekal BX) as wetting agent and 2-sulphanilamido-4,6-dichloro-1,3,5-triazine as hardener, the latter in a quantity of 0.07 mol per g. gelatin. The emulsion contained 1.5 g. silver bromide and 3.0 g. gelatin per $m^2$.

(b) A pigmented protective layer containing 4 g. gelatin and 10 g. finely divided titanium dioxide (rutile) per $m^2$. The same wetting agent was added to this layer as to layer (a) and the same hardener, but the latter in only half the quantity with respect to gelatin.

The layers (a) and (b) were applied either simultaneously or successively and then dried in a conventional coating plant.

The result is a composite photographic material (FIG. 1) which when rolled and cut to a suitable width is used in a printer for the automatic production of black and white prints.

The composite material, after exposure to a succession of images along its length (FIG. 2), is rolled up and then fed to a continuous processing machine where, at a temperature of 30° C., it is successively developed, fixed and washed (FIG. 3).

Immediately after washing, the surplus water is removed from the material by an air jet and the material is continuously glued to a 150 g/$m^2$ paper web and rolled, no intermediate drying taking place (FIG. 4). The adhesive used is a casein glue of a 20% solids content, which is applied in a thin layer between the image side of the auxiliary support and the paper web.

The glued web is coiled into a reel and finally cut into individual pictures by means of a conventional cutting machine (FIG. 5).

EXAMPLE 2

A total of 6 layers was applied in the following sequence to a 30μ thick film of biaxially stretched polypropylene:

(a) A red-sensitive silver bromide gelatin emulsion containing a water-soluble chromogenic coupler which couples with the oxidation product of a colour developer to form a blue-green dye.

(b) A gelatin intermediate layer containing 1.5 g. gelatin per $m^2$.

(c) A green-sensitive silver bromide gelatin layer containing a water-soluble chromogenic coupler which couples with the oxidation product of a colour developer to form a purple dye.

(d) A gelatin intermediate layer containing 1.5 g. gelatin per $m^2$.

(e) An insensitized blue-sensitive silver bromide gelatin layer containing a water-soluble chromogenic coupler which couples with a dye developer to form a yellow dye.

(f) A protective layer containing 4 g. of gelatin and 10 g. of finely divided titanium dioxide (rutile) per $m^2$.

The layers (a) to (e) constitute the photosensitive material 20: the layer (f) is the illustrated layer 30. As in the previous case, the layers contain the conventional wetting agent and hardening additives and other photographic additives such as sensitizers, stabilizers, and so on.

The layers are applied in the sequence indicated, either individually or a plurality simultaneously, and then dried. The result is a composite photographic material which is suitable for the production of positive colour prints from colour negatives.

A reel of the material in a suitable width is placed in an automatic printer for the production of colour positives. After exposure the reel of exposed material is fed to a continuous processing machine where it is subjected to one of the usual colour positive processes, e.g. successive colour development, silver bleach, and fixing in appropriate baths and treatment with the necessary intermediate and final washes.

The completely processed material can either be intermediately dried or, after the surplus adhering water has been blown off, can be fed directly to gluing machine as in Example 1 above, where it is glued to a paper support to form a finished colour print and is finally cut into individual pictures.

Example 1 above relates to a process in which the photosensitive emulsions are negative silver halide emulsions: Example 2 to a process in which the photosensitive emulsions are direct positive silver halide emulsions. The photosensitive material of the composite material may also be of the kind having photographic emulsions from which a colour print can be produced by diffusion transfer.

What is claimed is:

1. A composite photographic material comprising a transparent support layer which is a flexuous layer having a thickness of from about 5μ to 50μ, a light reflective layer and a photosensitive layer said reflective layer being between the support layer and the photosensitive layer.

2. A material as claimed in claim 1 in which said support layer has a thickness not less than 5μ.

3. A material as claimed in claim 2 in which said support layer has a thickness in the range of 15 to 30μ.

4. A material as claimed in claim 1 in which said support layer is water-resistant.

5. A material as claimed in claim 1 in which said support layer is a plastics film comprised of a material of the group constituted by: polyethylene, polypropylene, polystyrene, polyamide, polyimide, polysulphone, polyvinyl chloride, polyvinylidene chloride, polyacrylonitrile, regenerated cellulose, cellulose nitrate, cellulose acetate, and polyethylene terephthalate.

6. A material as claimed in claim 5 in which said plastics film is biaxially oriented.

7. A material as claimed in claim 5 in which said plastics film contains plasticizers.

8. A material as claimed in claim 1 in which said reflective layer incorporates a pigment of high reflecting power.

9. A material as claimed in claim 1 in which said reflective layer contains a developer or pre-developer for use in photographically processing the material.

* * * * *